United States Patent [19]

Boury

[11] Patent Number: 4,986,790

[45] Date of Patent: Jan. 22, 1991

[54] ROTATABLE DISK STRING TOY

[76] Inventor: Bradley J. Boury, 20430 Kemp, Mount Clemens, Mich. 48043

[21] Appl. No.: 492,104

[22] Filed: Mar. 12, 1990

[51] Int. Cl.[5] ..... A63H 1/32; A63H 1/06; A63H 33/22

[52] U.S. Cl. ..... 446/253; 446/266; 446/219

[58] Field of Search ..... 446/253, 254, 252, 251, 446/250, 249, 219, 259, 255, 266, 175

[56] References Cited

U.S. PATENT DOCUMENTS

| | | | |
|---|---|---|---|
| D. 193,566 | 9/1962 | Agrillo | 446/253 X |
| 617,089 | 1/1899 | Freeman | 446/253 |
| 668,829 | 2/1901 | Boehme | 446/250 |
| 1,864,318 | 6/1932 | Powell | 446/250 |
| 2,412,519 | 12/1946 | Kuhn | 446/253 X |
| 2,809,833 | 10/1957 | Slade | 446/250 X |
| 3,302,322 | 2/1967 | Rubio | 446/253 |
| 4,781,647 | 11/1988 | Doane, Jr. | 446/219 |
| 4,884,990 | 12/1989 | Lovik | 446/219 X |

FOREIGN PATENT DOCUMENTS

| | | | |
|---|---|---|---|
| 2252180 | 5/1974 | Fed. Rep. of Germany | 446/253 |
| 1048778 | 12/1953 | France | 446/253 |
| 2290930 | 6/1976 | France | 446/250 |

OTHER PUBLICATIONS

*Plastics That Glow in the Dark;* Modern Plastics, 10–1948, pp. 88–91.

*Primary Examiner*—Robert A. Hafer
*Assistant Examiner*—D. Neal Muir
*Attorney, Agent, or Firm*—Basile and Hanlon

[57] ABSTRACT

A rotatable disk string toy has two planar disks rotatably mounted on a continuous loop of string. A holder in the form of two connected rings is mounted on each other end of the loop of string to facilitate handling of the toy. The holder includes a first ring having a central aperture for receiving the fingers of the user. A second ring is mounted on one edge of the first ring and extends outward from the first ring. The second ring has a central aperture which slidably receives one end of the loop of string therethrough.

7 Claims, 1 Drawing Sheet

ROTATABLE DISK STRING TOY

BACKGROUND OF THE INVENTION

Field of the Invention

The present invention relates, in general, to toys. A long-time favorite toy is formed with two buttons or disks rotatably mounted on a continuous loop of string. The ends of the loop of string are grasped by the hands of the user and the string is rotated about a horizontal axis between the user's hands to wind up the string. Then, in and out reciprocating movement of the ends of the strings causes the string to unwind and rewind which forces the disks to oscillate back and forth along the string and strike each other.

While this toy provides long periods of enjoyment, it is not without a disadvantage. Since the user employs his or her fingers to grasp the ends of the loop of string, the fingers are susceptible to being pinched by the winding and unwinding action of the string. Looping the ends of the string through rings which the user grasps eliminates any pinching of the user's fingers. However, the string is typically tied to one of the rings which causes unequal tension in the upper and lower portions of the string during the unwinding and rewinding of the string and prevents the string from continuously rewinding. Thus, long term repeated use of such a toy has not been possible.

Thus, it would be desirable to provide a rotatable disk string toy which includes means to facilitate easy handling of the string. It would also be desirable to provide a rotatable disk string toy with string holding means which is easily attached to the toy. It would also be desirable to provide a rotating disk string toy which includes string holding means having an inexpensive cost. It would also be desirable to provide a rotating disk string toy which is durable for a long useful life. Finally, it would be desirable to provide a rotatable disk string toy which provides a unique visual appearance when in use.

SUMMARY OF THE INVENTION

The present invention is a rotatable disk string toy which includes unique string holding means which facilitates easy handling of the toy. The toy includes first and second planar disks which are rotatably mounted about a continuous loop of string. First and second bores are formed in each of the disks with the loop of string extending therethrough to outer ends disposed outward of each of the first and second disks. First and second means are provided for holding the outer ends of the loop of string. Each of the first and second holding means comprises a first ring having a central finger engaging aperture and a second ring fixedly attached to the exterior of the first ring. The second ring has a central aperture for receiving the loop of string therethough.

In a preferred embodiment, the first and second disks are formed of plastic, and particularly, a phosphorescent plastic. This causes the disks to glow in the dark after they have been previously exposed to light.

In use, the user grasps the first rings by his or her fingers and rotates the disks and string about a horizontal axis extending along the loop of string between the user's hands. When the string is completely wound to a tight condition, the user moves his or her hands in a reciprocating fashion in and out along the axis between the user's hands which causes the string to alternately unwind and rewind making the disks oscillate back and forth along the loop of string. As the disks alternately strike each other, they produce a distinctive loud "ka-lopp" sound. This reciprocating oscillation of the disks and the generation of sounds continues as long as the user desires.

The rotatable disk string toy of the present invention is provided with unique string holding means which facilitates easy holding of the toy and prevents the user's fingers from being pinched during the winding action of the string. By slidably receiving the string therethough, the string holding means also maintains the two half lengths of the loop of string at equal lengths during any unwinding and rewinding of the string which insures that the tension in the two half lengths of string is the same. This equal tension enables the toy to unwind and rewind repeatedly without stopping.

The rings which form the string holding means are inexpensively manufactured and easily attached to the toy. Further, in a preferred embodiment, the disks are formed of a phosphorescent material which glows in the dark after the disks have been exposed to light to provide a unique visual appearance when the toy is used in the dark.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
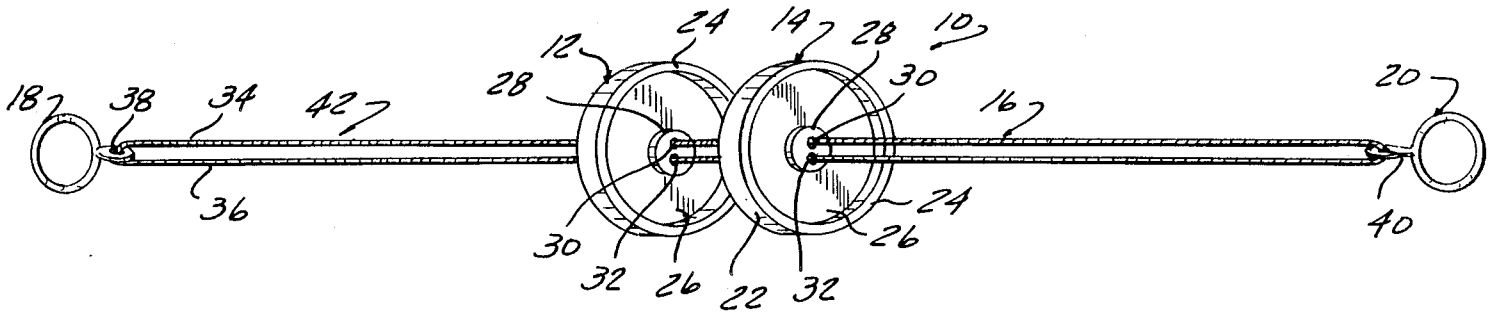
FIG. 1 is a perspective view of the rotatable disk string toy of the present invention.

Throughout the following description and drawing, an identical reference number is used to refer to the same component shown in multiple figures of the drawing.

Referring now to the drawing, and to FIG. 1 in particular, there is depicted a rotatable disk string toy 10 which produces a distinctive sound during use.

The rotatable disk string toy 10 includes first and second rotatable disks 12 and 14, respectively, a continuous loop string 16 and first and second holding means 18 and 20, respectively.

As shown in FIG. 1, each of the first and second disks 12 and 14 is identically constructed and is substantially planar in form with a circular cross section. Each of the disks 12 and 14, such as the rotatable disk 14, has an outer peripheral rim 22. The edges 24 of the rim 22 of each of the disks 12 and 14 extends outward beyond a central planar portion 26 of each disk 12 and 14.

A boss 28 is centrally located in the central planar portion 26 of each of the disks 12 and 14 and extends outward a short distance beyond both outer surfaces of the planar central portion 26. First and second bores 30 and 32 are formed in each of the bosses 28 and extend completely therethrough. The bosses 28 in each disk 12 and 14 add structural support for the bores 30 and 32 which prevents the bores 30 and 32 from enlarging and breaking through. The bosses 28 also provide a larger contact surface for the loop of string 16 passing through the bores 30 and 32. This reduces wear and potential breakage of the string 16 and increases the durability and useful life of the toy 10.

The first and second disks 12 and 14 are formed of any suitable material, such as wood, metal or plastic. However, plastic is a preferred material. In particular, a plastic which exhibits phosphorescent properties is preferred. This enables the disks 12 and 14 to glow in the dark after they have been exposed to light and provides a unique visual appearance for the toy 10 when it is operated in the dark.

The continuous loop string 16, when fully extended, has two planar, half length portions 34 and 36 which extend between outer ends 38 and 40. A knot 42 is formed between the loose ends of the string 16 to form the continuous loop. By way of example only, the string 16 has a planar length of approximately 16 inches between the ends 38 and 40 when the loop 16 is unwound and the string fully extended.

The string 16 may be formed of any suitable flexible material; although nylon is preferred over cotton for durability, longer useful life and smooth operation.

The planar portions 34 and 36 of the string 16 extend through the first and second bores 30 and 32 in each of the disks 12 and 14, with the outer ends 38 and 40 located a distance beyond the disks 12 and 14.

Figure 2:
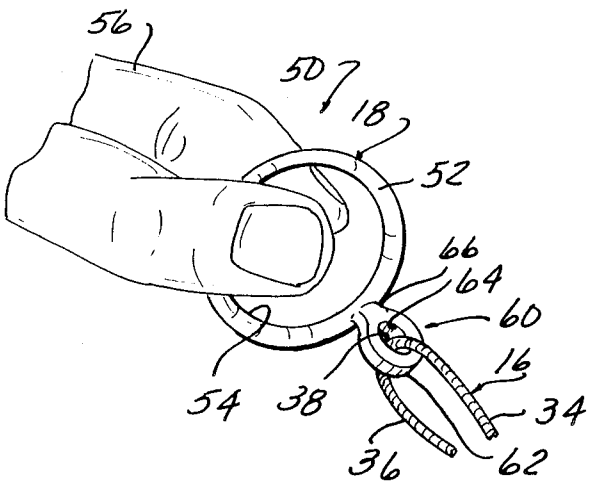
FIG. 2 is an enlarged, partial view showing the holding means employed in the toy shown in FIG. 1.

The first and second holding means 18 and 20 are respectively associated with the ends 38 and 40 of the loop of string 16 as shown in FIGS. 1 and 2. The first and second holding means 18 and 20 may be formed of any suitable material, such as plastic, wood or metal, with plastic being preferred for light weight and a low manufacturing cost.

Each of the first and second holding means 18 and 20 are identically formed such that the following discussion will be directed only to the first holding means 18. As shown more clearly in the enlarged view of FIG. 2, the first holding means 18 includes a first ring 50 and a second ring 60 which are rigidly or fixedly connected together. The first ring 50 has a circular rim portion 52 which bounds a central aperture 54. The aperture 54 is sized to enable the fingers, denoted in general by reference number 56 in FIG. 2, of a user to be disposed therethrough to securely grasp the first holding means 18.

The second ring 60 also includes a rim portion 62 and a central aperture 64. In a preferred embodiment, the second ring 60 is rigidly connected to the first ring 50 by means of an elongated arm 66 which extends from an edge of the rim 52 of the first ring 50 to the rim 62 of the second ring 60. Although the first and second rings 50 and 60 may be separately formed and then rigidly connected together by an adhesive or other suitable means, in a preferred embodiments, the first and second rings 50 and 60 are integrally formed as a single piece from a molded plastic.

In a preferred embodiment shown in FIG. 2, the second ring 60 is connected to the first ring 50 such that the plane of the rim 62 of the second ring 60 is substantially perpendicular to the plane of the rim 52 of the first ring 50. This enables the second ring 60 to receive the loop 16 of string therethough as clearly shown in FIG. 2.

By way of example only, the first ring 50 has a diameter of approximately one inch and the second ring 60 has a diameter of approximately ⅞ inches. This size of the rings 50 and 60 is smaller than the 2 ¼ inch diameter of the disks 12 and 14 which is disclosed by way of example only.

Figure 3:
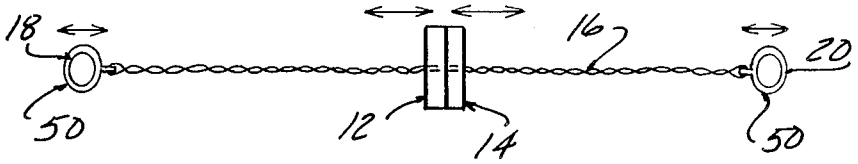
FIG. 3 is an operational view showing the condition of the toy after the string has been wound up and prior to oscillation of the holding means and the rotatable disks.

In use and with reference to FIG. 3, the user engages the first and second holding means 18 and 20 by inserting his or her fingers through the first ring 50 of each of the first and second holding means 18 and 20. The user then rotates the string 16 and the disks 12 and 14 about an axis extending between the rings 50 of each of the first and second holding means 18 and 20 until the string 16 is tightly wound up as shown in FIG. 3.

The user then oscillates his or her fingers and the first and second holding means 18 and 20 in a reciprocating manner back and forth or in and out, as shown by the arrows in FIG. 3, along the axis of the string 16 to cause the string to unwind and rewind. This reciprocating oscillatory motion causes the disks 18 and 20 to oscillate or move back and forth in the direction shown by the arrows in FIG. 3 along the string 16 as the string 16 unwinds and rewinds. When the rim edges 24 of each of the disks 12 and 14 strike each other they produce a loud distinctive "kalopp" sound. This sound is reproduced each time the disks 12 and 14 strike each other after moving apart and then again moving towards each other. This process may be continued endlessly as long as the user desires.

However, during the use of the toy 10, the user's fingers are protected from any pinching action of the string 16 since the user's fingers are disposed in the first ring 50 of each of the first and second holding means 18 and 20 and thereby separated from the ends 38 and 40 of the string 16.

In summary, there has been disclosed a unique rotatable disk string toy which prevents any pinching of the user's fingers during the use of the toy. The unique string holding means employed in the toy of the present invention prevents such pinching action by separating the point of attachment of the user's fingers to the string holding means from the string on which the disks are mounted. The holding means are inexpensive and easily attached to the rotatable disk string toy. In a preferred embodiment, the disks are formed of a phosphorescent material which glows in the dark to provide a unique and striking visual appearance during the use of the toy in the dark.

What is claimed is:

1. A toy comprising:

first and second disks;

first and second bores formed in each of the first and second disks and extending therethrough;

a continuous loop of string extending through the first and second bores in the first and second disks and outward of the first and second disks to outer ends;

first and second means for holding the outer ends of the loop of string, each of the first and second holding means comprising:

a first ring having a central finger engaging aperture and a second ring fixed attached to and extending away from the first ring, the second ring having a central aperture for slidably receiving the loop of string therethrough.

2. The toy of claim 1 wherein the first and second rings are integrally formed as a single piece of molded plastic and the second ring is a closed annular member.

3. The toy of claim 1 wherein the first ring has a larger diameter than the diameter of the second ring.

4. The toy of claim 1 wherein the first and second disks are formed of a phosphorescent plastic material.

5. The toy of claim 1 wherein each of the first and second rings is planar in form, the first and second rings being fixedly joined together with the plane of the second ring being perpendicular to the plane of the first ring.

6. The toy of claim 1 further including:

each of the first and second disks being formed of a substantially planar central portion and a peripheral rim portion, the edges of the peripheral rim portion extending outward from both sides of the central planar portion;

at least one boss centrally mounted on and extending outward from the central planar portion of each of the first and second disks, the at least one boss extending outward a distance less than the distance of the edge of the peripheral rim from the central planar portion; and the first and second bores extending through the boss, the first and second bores slidably receiving the loop of string therethrough.

7. The toy of claim 1 wherein each of the first and second rings is planar in form, the first and second rings being fixedly joined together with the plane of the second ring being angularly offset from the plane of the first ring.

* * * * *